United States Patent [19]

Ruback et al.

[11] Patent Number: 4,963,274

[45] Date of Patent: Oct. 16, 1990

[54] CONCENTRATED FABRIC CONDITIONERS

[75] Inventors: Wulf Ruback, Recklinghausen; Jan Schut, Niederlande; Werner Friedrich, Herten; Heinz Riemer, Bottrop; Hauke Steinhardt, Herne, all of Fed. Rep. of Germany

[73] Assignee: Huels Aktiengesellschaft, Marl, Fed. Rep. of Germany

[21] Appl. No.: 203,999

[22] Filed: Jun. 8, 1988

[30] Foreign Application Priority Data

Jun. 19, 1987 [DE] Fed. Rep. of Germany ..... 3720331

[51] Int. Cl.[5] ..... C11D 7/32; C11D 7/34; C11D 7/36

[52] U.S. Cl. ..... 252/8.75; 252/8.6; 252/8.8; 252/8.9

[58] Field of Search ..... 252/8.6, 8.7, 8.75, 252/8.8, 8.9, 544, 545, 547, 548, 525, 526, 528, 529

[56] References Cited

U.S. PATENT DOCUMENTS 4,767,547 8/1988 Straathof ..... 252/8.8

FOREIGN PATENT DOCUMENTS 159263 3/1983 German Democratic Rep. .
0031376 5/1985 Japan .

*Primary Examiner*—Prince E. Willis
*Assistant Examiner*—Kathleen Markowski
*Attorney, Agent, or Firm*—Oblon, Spivak, McClelland, Maier & Neustadt

[57] ABSTRACT

A fabric conditioner comprising 18 to 50% by weight of a mixture of at least two quaternary ammonium salt components (A) and (B) with the remainder of the conditioner being water and auxiliary agents.

15 Claims, No Drawings

CONCENTRATED FABRIC CONDITIONERS

BACKGROUND OF THE INVENTION

1. Field of the Invention

The present invention relates to a conditioner used in the softening of fabric.

2. Description of the Background

It is known that washed textiles exhibit unpleasant hardening after drying. Moreover, the washing of clothes in modern households in automatic washing machines and small drying rooms contributes to hardening of the clothes. This hardening is undesired since it adversely affects the wear properties of textiles.

It is possible to eliminate handle hardening of this type by treating the textiles, after washing, in a rinse bath with cationic substances which contain at least two long-chain, aliphatic moieties. These cationic substances are usually prepared in the form of aqueous dispersions which are added to the rinse bath. Up to a concentration of 10 to 15%, dispersions of this type can be prepared relatively easily. However, formulations of higher concentrations become viscous or gelatinous after a short storage time and cannot be dispersed in cold water without gelling. A good concentrated fabric conditioner must therefore meet the following demands: (i) When formulated it must keep its homogeneity during storage; (ii) Formulations must retain a thin consistency during the storage time; and (iii) The conditioner must exhibit good dispersability in cold water.

In order to meet these objectives, solutions have been formulated in the past as described in EP-B1-0,085,933 and EP-B1-0,094,655, which contain the combination of a fabric conditioner component with one or more dispersion auxiliaries through which the desired properties of the formulation are achieved. Between 15 and 60 percent by weight of a dispersion auxiliary, relative to the cationic substance active as fabric conditioner components, are required here.

The use of such large amounts of dispersant makes the conditioner formulations much more expensive or complex so that the advantage of concentrates, that is, their normally much less distribution expenditures is, in part, counteracted again. In addition, the conditioning properties of the raw materials are generally adversely affected by large amounts of dispersant. In order to formulate the fabric conditioner concentrates desired, it is therefore necessary, at present, to accept a number of disadvantages. A need therefore continues to exist for a conditioner which can be more advantageously used as a concentrate.

SUMMARY OF THE INVENTION

Accordingly, one object of the present invention is to provide a fabric conditioner which is readily free-flowing, even in concentrated form, i.e. up to a 50 per cent by weight aqueous solution, and accomplishes this objective without the aid of a dispersant.

Briefly, this object and other objects of the invention as hereinafter will become more readily apparent can be attained by a fabric conditioner which comprises (a) from 18 to 50 percent by weight of a mixture of at least two conditioner components comprising 10 to 90 percent by weight of a compound of the formula (A):

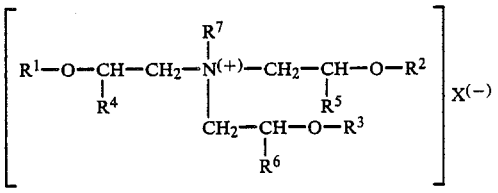

in which $R^1$, $R^2$ and $R^3$, independently of one another, each are a linear, saturated or unsaturated acyl radical having 8 to 24, preferably 12 to 20, carbon atoms, or hydrogen if two of the groups $R^1$, $R^2$ and $R^3$ are acyl; $R^4$, $R^5$ and $R^6$, independently of each another, are hydrogen or alkyl of 1 to 4, preferably 1 or 2, carbon atoms; $R^7$ is alkyl of 1 to 4, preferably 1 or 2, carbon atoms, and X is Cl, Br, I, $1/2SO_4$, $MeOSO_3$, $(MeO)_2PO_2$, $1/2MeOPO_3$, $(EtO)_2PO_2$, $1/2EtOPO_3$ or $EtOSO_3$, and 90 to 10 percent by weight of at least one compound of the formula (B):

(i)

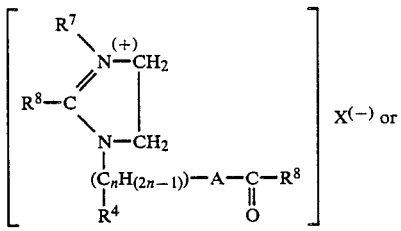

(ii)

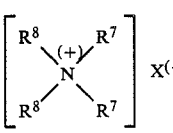

(iii)

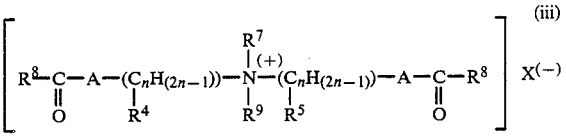

in which $R^4$, $R^5$, $R^7$ and X each have the same meaning as described above, and $R^8$ is a saturated or unsaturated alkyl radical having 8 to 24, preferably 12 to 20, carbon atoms; $R^9 = R^7$ or a polyalkylene oxide group, and A is O, S, NH or NR, or mixtures thereof, and n represents an integer from 1 to 6, preferably 2 or 3, with components (A) and (B) adding up to 100 percent by weight; and (b) water and, where appropriate, further customary auxiliaries, such as, for example, salts, short-chain alcohols, dyes, perfumes and perfume emulsifier, making up to 100 percent by weight.

DETAILED DESCRIPTION OF THE PREFERRED EMBODIMENTS

In a preferred embodiment of the invention, the fabric conditioner contains 25 to 50, in particular 25 to 40, percent by weight of a mixture (a) of the two conditioner components (A) and (B).

In a more preferred embodiment, the mixture (a) of the two conditioner components comprises 20 to 70, preferably 30 to 60, percent by weight of a compound of the formula (A) and 80 to 30, preferably 70 to 40, percent by weight of a compound of the formula (B).

The compound of the formula (iii) above of component B preferably is such that group $R^9$ represents a group of the formula:

$$-(CH_2-\underset{\underset{R^7}{|}}{CH}-O)_m-H.$$

in which $R^7$ has the abovementioned meaning and m represents a number from 1 to 6.

In a preferred embodiment of the invention, the compound (iii) of conditioner component (B) has the formula:

$$\left[R^8-\underset{\underset{O}{\|}}{C}-NH-CH_2-CH_2-\overset{\overset{CH_3}{|}}{\overset{(+)}{N}}-CH_2-CH_2-NH-\underset{\underset{O}{\|}}{C}-R^8 \;\; (CH_2-CH_2-O)_m-H\right] X^{(-)}$$

in which $R^8$, m and X have the meanings defined above.

In another preferred embodiment of the invention the compound (i) of conditioner component (B) has the following formula:

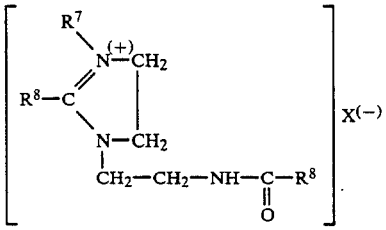

wherein $R^7$, $R^8$ and X have the meanings defined above.

In a most preferred embodiment of the invention, the compound of formula for the conditioner component (A) is:

$$\left[R^1-O-CH_2-CH_2-\overset{\overset{CH_3}{|}}{\overset{(+)}{N}}-CH_2-CH_2-O-R^2 \;\; CH_2-CH_2-O-R^3\right] X^{(-)}$$

wherein $R^1$, $R^2$, $R^3$ and X have the meanings defined above.

The mixtures which constitute component (a), of at least two conditioner components (A) and (B) can be prepared either by simply blending these components or by blending their nonquaternized precursors with subsequent common quaternization. They are generally formulated as 75 to 95 percent by weight raw materials, it being possible for the remainder up to 100 percent by weight to comprise water or a short-chain alcohol or a mixture of the two. Further additives may be added as desired to complete processing within the scope of the invention.

The formulations obtained are readily free-flowing and can be dispersed in cold water.

Fabric conditioners are generally added in a customary manner to the final rinse bath via a specific dispenser in the washing machine Since the fabric conditioner remains in this dispenser while the entire washing program proceeds, it is possible that residual amounts of product are not rinsed into the washed clothing, which is particularly the case of products which have a flow limit, depending on the design of the dispenser in the machine and its arrangement in the washing machine Such problems can be excluded by adding 0.001 to 10 percent by weight, preferably 0.01 to 5 percent by weight, in particular 0.05 to 2 percent by weight, of a dispersion auxiliary, relative to the amount of substances which function as fabric conditioners, to the fabric conditioner concentrates on which the present invention is based. Suitable dispersion auxiliaries are compounds of the formulae C

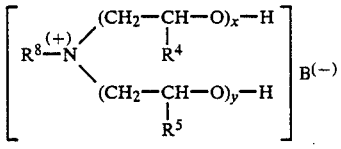

(i)

and/or

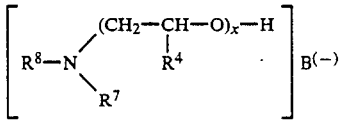

(ii)

wherein $R^4$, $R^5$, $R^7$, $R^8$ and n have the meanings defined above and x and y denote integers between 1 and 80, the sum of x and y being an integer between 2 and 80, and $B^{(-)}$ is the anion of a mineral acid, a sulfonic acid, an alkylsulfuric acid, a carboxylic acid or an ether carboxylic acid.

Suitable compounds (A) can be prepared, for example, from trialkanolamines such as triethanolamine, triisopropanolamine, triisobutanolamine, diethanolmonoisopropanolamine, and the like by the reaction of an alkanolamine with fatty acids or fatty acid methyl esters which contain an alkyl radical having 8 to 22 C atoms in the acid portion of the molecule. A reaction of this type is described, for example, in U.S. Pat. No. 3,915,867. Examples of suitable fatty acids for the reaction with the trialkanolamine include caprylic acid, capric acid, lauric acid, myristic acid, palmitic acid, stearic acid, oleic acid, arachidic acid, behenic acid, and the like, as well as the unsaturated isomers thereof It is also possible to employ, in particular, mixtures of the fatty acids mentioned, preferably the naturally occurring fatty acid mixtures, such as tallow fatty acid, coconut fatty acid, palm oil fatty acid, and the like. The fatty acids are expediently chosen in the form of their methyl esters for the reaction After this reaction, quaternization is carried out in a customary manner, for example using a lower alkyl ester of a mineral acid such as dimethyl sulfate, diethyl sulfate, methyl iodide, methyl chloride, methyl bromide, ethyl chloride, trimethyl phosphate or triethyl phosphate.

The compound (i) of conditioner component (B) can be prepared by reacting, for example, dialkylenetriamines such as diethylenetriamine, aminopropylethylenediamine or aminobutylethylenediamine, or hydroxyalkylethylenediamines such as 2-hydroxyethylethylenediamine, (2-hydroxy-1-methylethyl)ethylenediamine, 3-hydroxypropylethylenediamine or (2-hydroxy-1ethylethyl)ethylenediamine, with fatty acids which are generally the same as those used in the preparation of component A, under condensation conditions with subsequent quaternization with the aid of a lower alkyl ester of a mineral acid, as described in greater detail for the preparation of component A.

The compound of formula (ii) for conditioner component (B) is obtained by reacting difattyalkylamines with the lower alkyl esters of mineral acids described above.

Compounds of the formula (iii) for component (B) can be obtained, for example, by reacting fatty acids, such as those mentioned above, with dialkylenetriamines, or hydroxyalkylalkylenediamines of the type mentioned above, which are subsequently ethoxylated and quaternized.

Suitable compounds of component (A) include for example: N-methyltriethanolammoniumdi(stearic acid) ester methylsulfate, N-methyltriisopropanolammoniumdi(stearic acid)ester methylsulfate, N-methyltriisobutanolammoniumdi(stearic acid) ester methylsulfate, N-methyldiethanolmonoisopropanolammoniumdi(stearic acid) methylsulfate, N-methylmonoethanoldiisopropanolammoniumdi(stearic acid) methylsulfate, N-methyltriisopropanolammoniumdi(tallow fatty acid) methylsulfate, N-ethyltriethanolammoniumdi(palmitic acid) chloride, N-ethyltriisopropanolammoniumdi(palm oil fatty acid) chloride, N-methyltriisobutanolammoniumdi(tallow fatty acid) chloride and N-methyltriethanolammoniumdi(palmitic fatty acid) ester methylsulfate.

Suitable compounds of formula (i) of component (B) include di(tallow fatty acid)alkylimidazolinium methylsulfate, di(stearic acid)alkylimidazolinium methylsulfate, di(oleic acid)alkylimidazolinium methylsulfate, di(palmitic acid)alkylimidazolinium chloride and di(tallow fatty acid)alkylimidazolinium chloride.

Suitable compounds of the formula (ii) of component (B) include, for example, distearyldimethylammonium chloride, dipalmityldimethylammoniumchloride, dibehenyldimethylammonium chloride, diarachlydiethylammonium chloride, dimyristyldimethylammonium methylsulfate, dioleyldiethylammonium chloride, di(tallow fatty alkyl)dimethylammonium chloride and di(hardened tallow fatty alkyl)dimethylammonium chloride.

Suitable compounds of formula (iii) of component (B) include N-methyl-N-triethoxy-N,N-bis-[2-(tallow fatty amido)ethyl]ammonium methylsulfate, N-methyl-N-tetraethoxy-N,N-bis[2-(stearylamido)ethyl]ammonium chloride, N-ethyl-N-diethoxy-N,N-bis[2-(oleic acid amido)ethyl]ammonium chloride, and N-propyl-N-pentaethoxy-N,N-bis[2-(palmitylamido)ethyl]ammonium methylsulfate.

The dispersants of formulas (i) and (ii) of component (C), which are employed when appropriate, in small amounts., can be prepared in a known fashion by reacting an alkylamine or the likes with ethylene oxide, propylene oxide, butylene oxide or combinations thereof and subsequently reacting (neutralizing) the product with a mineral acid, a carboxylic acid, a sulfonic acid, a polyethercarboxylic acid or mixtures thereof in amounts such that the acid:base equivalents ratio ranges from 0.9 to 1.1.

Having generally described this invention, a further understanding can be obtained by reference to certain specific examples which are provided herein for purposes of illustration only and are not intended to be limiting unless otherwise specified In the examples below, embodiments of fabric conditioners formulations of the invention are described. In all cases, percentages are percentage by weight. In all cases, the fabric conditioners are produced by initially preparing tap water at a temperature between 20° and 50° C., stirring the components specified into the water, and subsequently stirring until cold, if appropriate. For the properties of the formulations, it is of advantage if the fabric conditioner components A) and B) are employed as a previously prepared mixture, but it is also possible, if required, to stir in the individual components successively.

Example 1

(I) 30% of a conditioner mixture comprising: (i) 5 parts of N-methyltriethanolammoniumdi(tallow fatty acid) ester methylsulfate and (ii) 5 parts of di(tallow fatty acid)alkylimidazolinium methylsulfate;

(II) 3% of a 25% strength $CaCl_2$ solution; and the remainder tap water (13° hardness (German)), perfume and a coloring agent to bring the components to 100%.

Viscosity ($D=50\ sec^{-1}$, 25° C.) 140 mPa s.

Example 2

(I) 30% of a conditioner mixture comprising: (i) 5 parts of N-methyltriethanolammoniumdi(tallow fatty acid) ester methylsulfate and (ii) 5 parts of N-methyl-N-polyethoxy-N,N-bis[2-(tallow fatty amido)ethyl]ammonium methylsulfate;

(II) 4% of a 25% strength $CaCl_2$ solution; and the remainder tap water (13° hardness (German)), perfume and a coloring agent to bring the components to 100%.

Viscosity ($D=100\ sec^{-1}$, 25 ° C.): 253 mPa s

Example 3

(I) 20% of a conditioner mixture comprising: (i) 5 parts of N-methyltriethanolammoniumdi(tallow fatty acid) ester methylsulfate and (ii) 5 parts of di(tallow fatty acid)alkylimidazolinium methylsulfate;

(II) 1.2% of a 25% strength $CaCl_2$ solution; and the remainder tap water (13° hardness (German)), perfume and a coloring agent to bring the components to 100%.

Viscosity ($D=100\ sec^{-1}$, 25° C.): 15 mPa s.

Example 4

(I) 15% of di(tallow fatty acid)alkylimidazolinium methylsulfate, (II) 15% of N-methyltriethanolammoniumdi(tallow fatty acid) ester methylsulfate stirred in successively;

(III)4of a 25% strength $CaCl_2$ solution; and the remainder tap water (13° hardness (German)), perfume and a coloring agent to bring the components to 100%. Viscosity ($D=50\ sec^{-1}$, 25° C.): 300 mPa s.

Example 5

(I) 40% of a conditioner mixture comprising: (i) 2 parts of N-methyltriethanolammoniumdi(tallow fatty acid) ester methylsulfate and (ii) 8 parts of di(tallow fatty acid) alkylimidazolinium methylsulfate;

(II) 4% of a 25% strength $CaCl_2$ solution; and the remainder tap water (13° hardness (German)), perfume and a coloring agent to bring the components to 100%.

Viscosity ($D=100\ sec^{-1}$, 25° C.): 260 mPa s.

Flow limit: 5 Pa

Example 6

(I) 25% of a conditioner mixture comprising: (i) 8 parts of N-methyltriethanolammoniumdi(tallow fatty acid) ester methylsulfate and (ii) 2 parts of di(tallow fatty acid)alkylimidazolinium methylsulfate;

(II) 4% of a 25% strength $CaCl_2$ solution; and the remainder tap water (13° hardness (German)), perfume and a coloring agent to bring the components to 100%.

Viscosity (D=100 $sec^{-1}$, 25° C.): 60 mPa s.

Example 7

(I) 35% of a conditioner mixture comprising: (i) 1 part of N-methyltriethanolammoniumdi(tallow fatty acid) ester methylsulfate and (ii) 9 parts of di(tallow fatty acid)alkylimidazolinium methylsulfate;

(II) 4% of a 25% strength $CaCl_2$ solution; and the remainder tap water (13° hardness (German)), perfume and a coloring agent to bring the components to 100%

Viscosity (D=100 $sec^{-1}$, 25° C.): 242 mPa s.

Example 8

(I) 20% of a conditioner mixture comprising: (i) 5 parts of N-methyltriethanolammoniumdi(tallow fatty acid) ester methylsulfate and (ii) 5 parts of distearyldimethylammonium chloride, (II) 1.5% of a 25% $CaCl_2$ solution; and the remainder tap water (13° hardness (German)), perfume and a coloring agent to bring the components to 100%.

Viscosity (D=50 $sec^{-1}$, 25° C.): 58 mPa s.

Example 9

(I) 30% of a conditioner mixture comprising: (i) 5 parts of N-methyltriethanolammoniumdi(tallow fatty acid) ester methylsulfate, and (ii) 5 parts of N-methyl-N-polyethoxy-N,N-bis[2-(tallow fatty amido)ethyl]ammonium methylsulfate, and (iii) 1% of a dispersant comprising a molar mixture of oleylamine+40 EO and oleic acid, (II) 4% Of a 25% strength $CaCl_2$ solution; and the remainder tap water (13° hardness (German)), perfume and a coloring agent to bring the components to 100%.

Viscosity (D=50 $sec^{-1}$, 25° C.): 85 mPa s.

Example 10

(I) 25% of a conditioner mixture comprising: (i) 2 parts of N-methyltriethanolammoniumdi(tallow fatty acid) ester methylsulfate and (ii) 8 parts of N-methyl-N-polyethoxy-N,N-bis[2-(tallow fatty amido)ethyl]ammonium methylsulfate, (II) 0.7% of a 25% strength $CaCl_2$ solution; and the remainder tap water (13° hardness (German)), perfume and a coloring agent to bring the components to 100%.

Viscosity (D=100 $sec^{-1}$, 25° C.): 57 mPa s.

Example 11

(I) 40% of a conditioner mixture comprising (i) 2 parts of N-methyltriethanolammoniumdi(tallow fatty acid) ester methylsulfate and (ii) 8 parts of di(tallow fatty acid)alkylimidazolinium methylsulfate; and (II) 0.25% of a dispersant comprising a molar mixture of oleylamine+35 EO and laurylalcohol polyglycol ether (10 EO) acetic acid;

(III) 3.5% of a 25% strength $CaCl_2$ solution; and the remainder tap water (13° hardness (German)), perfume and a coloring agent to bring the components to 100%.

Viscosity (D=50 $sec^{-1}$, 25° C.): 230 mPa s.

Flow limit: 0.2 Pa.

The formulations produced meet the customary demands regarding temperature stability and shelf life.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A fabric conditioner mixture, comprising:

(a) 18–50% by weight of a mixture of at least two conditioner components (A) and (B), said mixture comprised of 10 to 90% by weight of a compound of the formula (A):

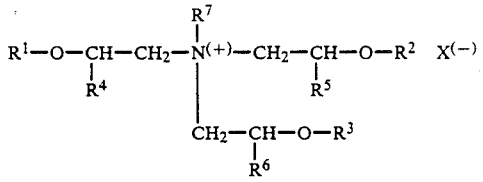

wherein $R^1$, $R^2$ and $R^3$, independently of one other are each a linear, saturated or unsaturated acyl radical having 8 to 24 carbon atoms, or hydrogen, with the proviso that one of $R^1$, $R^2$ and $R^3$ is hydrogen and two of the groups $R^1$, $R^2$ and $R^3$ must be acyl; $R^4$, $R^5$ and $R^6$, independently of each other, are hydrogen or an alkyl radical having 1 to 4 carbon atoms; $R^7$ is an alkyl radical having 1 to 4 carbon atoms; and X is Cl, Br, I, $1/2SO_4$, $MeOSO_3$, $(MeO)_2PO_2$, $1/2MeOPO_3$, $(EtO)_2PO_2$, $1/2EtOPO_3$ or $EtOSO_3$; and 90 to 10 percent by weight of at least one compound of the formula (B):

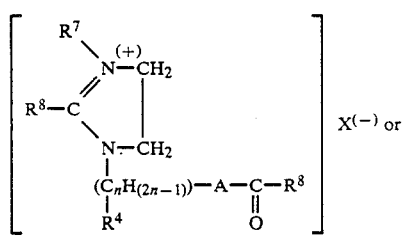

(i)

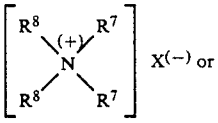

(ii)

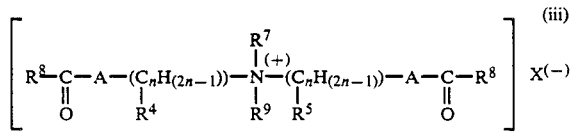

(iii)

wherein $R^4$, $R^5$, and $R^7$ and X are as defined above, and $R^8$ is a saturated or unsaturated alkyl radical having 8 to 24 carbon atoms, $R^9=R^7$ or a polyalkylene oxide group, and A is O, S, or NH, or combinations thereof, and n represents an integer from 1 to 6, said components (A) and (B) add up to 100% by weight of the mixture of conditioner components; and (b) 82 to 50% by weight water and, optionally at least one auxiliary which is employable in fabric conditioners, which bring the conditioner formulation up to 100% by weight.

2. The fabric conditioner according to claim 18, which contains 30 to 50 percent by weight of a mixture of the two conditioner components (A) and (B).

3. The fabric conditioner according to claim 1, wherein the mixture (a) of the two conditioner components comprises 20 to 70 percent by weight of a compound of the formula (A) and 80 to 30 percent by weight of a compound of the formula (B).

4. The fabric conditioner according to claim 1, wherein, in the compound of formula (iii) of component (B), $R^9$ represents a group of the formula $$-(CH_2-\underset{\underset{R^7}{|}}{CH}-O)_m-H.$$

in which $R^7$ is as defined above and m represents a number from 1 to 6.

5. The fabric conditioner according to claim 1, wherein the compound of formula (iii) of component (B) has the structure:

$$\left[R^8-\underset{\underset{O}{\|}}{C}-NH-CH_2-CH_2-\overset{\overset{CH_3}{|}}{\underset{\underset{(CH_2-CH_2-O)_m-H}{|}}{N^{(+)}}}-CH_2-CH_2-NH-\underset{\underset{O}{\|}}{C}-R^8\right]X^{(-)}$$

in which $R^8$, m and X are as defined above.

6. The fabric conditioner according to claim 1, wherein the compound of formula (i) of component (B) has the structure:

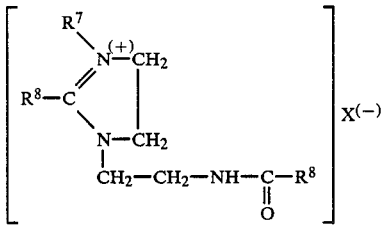

in which $R^7$, $R^8$ and X are as defined above.

7. The fabric conditioner according to claim 1, wherein the compound of component (A) has the structure:

$$\left[R^1-O-CH_2-CH_2-\overset{\overset{CH_3}{|}}{\underset{\underset{CH_2-CH_2-O-R^3}{|}}{N^{(+)}}}-CH_2-CH_2-O-R^2\right]X^{(-)}$$

in which $R^1$, $R^2$, $R^3$ and X are as defined above.

8. The fabric conditioner according to claim 3, wherein the mixture a) of the two conditioner components comprises 30 to 60% by weight of the compound of formula (A) and 70 to 40% by weight of a compound of formula (B).

9. The fabric conditioner according to claim 1, wherein said composition further comprises 0.001 to 10% by weight of a dispersion auxiliary.

10. The fabric conditioner according to claim 9, wherein the amount of said dispersion auxiliary ranges from 0.01 to 5% by weight.

11. The fabric conditioner according to claim 1, wherein the compound of formula (A) is N-methyltriethanolammoniumdi (stearic acid) ester methylsulfate, N-methyltriisopropanolammoniumdi(stearic acid)ester methylsulfate, N-methyltriisobutanolammoniumdi-(stearic acid) ester methylsulfate, N-methyldiethanolmonoisopropanolammoniumdi(stearic acid) methylsulfate, N-methylmonoethanoldiisopropanolammoniumdi(stearic acid) methylsulfate, N-methyltriisopropanolammoniumdi(tallow fatty acid) methylsulfate, N-ethyltriethanolammoniumdi(palmitic acid) chloride, N-ethyltriisopropanolammoniumdi(palm oil fatty acid) chloride, N-methyltriisobutanolammoniumdi(tallow fatty acid) chloride and N-methyltriethanolammoniumdi(palmitic fatty acid) ester methylsulfate.

12. The fabric conditioner according to claim 1, wherein the compound of formula (i) of component (B) is di(tallow)fatty acid)alkylimidazolinium methylsulfate, di(stearic acid)alkylimidazolinium methylsulfate, di(oleic acid)alkylimidazolinium methylsulfate, di(palmitic acid)alkylimidazolinium chloride and di(tallow fatty acid)alkylimidazolinium chloride.

13. The fabric conditioner according to claim 1, wherein the compound of formula (ii) of component (B) is distearyldimethylammonium chloride, dipalmityldimethylammoniumchloride, dibehenyldimethylammonium chloride, diarachidyldiethylammonium chloride, dimyristyldimethylammonium methylsulfate, dioleyldiethylammonium chloride, di(tallow fat)dimethylammonium chloride and di(hardened tallow fat)dimethylammonium chloride.

14. The fabric condition according to claim 1, wherein the compound of formula (iii) of component (B) is N-methyl-N-triethoxy-N,N-bis-[2-(tallow fatty amido)ethyl]ammonium methylsulfate, N-methyl-N-tetraethoxy-N,N-bis[2-(stearylamido)ethyl]ammonium chloride, N-ethyl-N-diethoxy-N,N-bis[2-(oleic acid amido)ethyl]ammonium chloride, and N-propyl-N-pentaethoxy-N,N-bis[2-(palmitylamido)ethyl]ammonium methylsulfate.

15. The fabric conditioner according to claim 9, comprising at least one dispersion auxiliary of the formula $$\left[R^8-\overset{(+)}{N}\begin{matrix}(CH_2-CHR^4-O)_x-H\\(CH_2CHR^5-O)_y-H\end{matrix}\right]B^{(-)}\text{ or}$$

$$\left[R^8-N\begin{matrix}(CH_2-CHR^4-O)_x-H\\R^7\end{matrix}\right]B^{(-)}$$

wherein $R^4$, $R^5$, $R^7$ and $R^8$ are as defined above and x and y each is an integer ranging from 1 to 80 with the sum of x and y being between 2 and 80 and B is an anion.

* * * * *